US010724320B2

(12) United States Patent
Huang et al.

(10) Patent No.: US 10,724,320 B2
(45) Date of Patent: Jul. 28, 2020

(54) NON-EXPLOSIVE DOWNHOLE PERFORATING AND CUTTING TOOLS

(71) Applicant: Schlumberger Technology Corporation, Sugar Land, TX (US)

(72) Inventors: Hongfa Huang, Sugar Land, TX (US); Delbert Taylor, Damon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 208 days.

(21) Appl. No.: 15/520,853

(22) PCT Filed: Oct. 19, 2015

(86) PCT No.: PCT/US2015/056161

§ 371 (c)(1),
(2) Date: Apr. 21, 2017

(87) PCT Pub. No.: WO2016/069305

PCT Pub. Date: May 6, 2016

(65) Prior Publication Data

US 2017/0335646 A1 Nov. 23, 2017

Related U.S. Application Data

(60) Provisional application No. 62/165,655, filed on May 22, 2015, provisional application No. 62/073,929,
(Continued)

(51) Int. Cl.
*E21B 29/02* (2006.01)
*E21B 43/114* (2006.01)
(Continued)

(52) U.S. Cl.
CPC ..... *E21B 29/02* (2013.01); *E21B 34/063* (2013.01); *E21B 43/11* (2013.01); *E21B 43/114* (2013.01)

(58) Field of Classification Search
CPC ..... E21B 29/02; E21B 43/11
See application file for complete search history.

(56) References Cited

U.S. PATENT DOCUMENTS

RE20,832 E * 8/1938 Wells ..... E21B 36/00 166/300
2,191,783 A 2/1940 Wells
(Continued)

FOREIGN PATENT DOCUMENTS

GB GB2065750 A 7/1981
WO WO2013135583 A2 9/2013
(Continued)

OTHER PUBLICATIONS

Extended Search Report issued in the related EP Application 15855623.3 dated Jun. 29, 2018 (7 pages).
(Continued)

*Primary Examiner* — Kipp C Wallace
(74) *Attorney, Agent, or Firm* — Cameron R. Sneddon

(57) ABSTRACT

A non-explosive downhole tool for creating openings in tubulars and or earthen formations includes a carrier holding a non-explosive material, such as thermate, a head connected with the carrier and having a port to eject a product of the ignited material from the head and a communication path extending from the material to the port and a moveable member in a closed position blocking the communication path and in an open position opening the communication path.

18 Claims, 12 Drawing Sheets

Related U.S. Application Data filed on Oct. 31, 2014, provisional application No. 62/086,412, filed on Dec. 2, 2014, provisional application No. 62/090,643, filed on Dec. 11, 2014.

(51) Int. Cl.
*E21B 34/06* (2006.01)
*E21B 43/11* (2006.01)

(56) References Cited

U.S. PATENT DOCUMENTS 2,286,075 A 6/1942 Evans et al.
2,789,004 A * 4/1957 Foster ..... E21B 31/007 164/332
3,318,381 A * 5/1967 Brandt ..... E21B 33/138 166/100
4,125,161 A * 11/1978 Chammas ..... E21B 23/04 166/212
4,216,721 A 8/1980 Marziano et al.
4,298,063 A 11/1981 Regalbuto et al.
4,585,158 A 4/1986 Wardlaw, III
4,598,769 A 7/1986 Robertson
4,619,318 A * 10/1986 Terrell ..... E21B 29/02 166/212
4,808,037 A * 2/1989 Wade ..... E02B 17/00 166/55
4,996,922 A 3/1991 Halcomb et al.
5,129,305 A * 7/1992 Reilly ..... B23K 7/08 102/364
5,411,049 A 5/1995 Colvard
5,435,394 A 7/1995 Robertson
5,833,001 A 11/1998 Song et al.
6,131,801 A 10/2000 Hagen
6,186,226 B1 * 2/2001 Robertson ..... E21B 29/02 166/297
6,598,679 B2 7/2003 Robertson
6,766,744 B1 7/2004 Song et al.
6,925,937 B2 8/2005 Robertson
7,124,820 B2 10/2006 Wardlaw
7,290,609 B2 11/2007 Wardlaw et al.
7,690,428 B2 4/2010 Robertson
7,726,392 B1 6/2010 Robertson
7,900,704 B2 3/2011 Robertson
7,934,552 B2 5/2011 La Rovere
7,997,332 B2 8/2011 Robertson
8,020,619 B1 * 9/2011 Robertson ..... E21B 17/026 166/297
8,167,044 B2 5/2012 Huang et al.
8,196,515 B2 6/2012 Streibich et al.
8,235,102 B1 8/2012 Robertson
8,327,926 B2 12/2012 Robertson
8,336,612 B2 12/2012 Robertson et al.
8,474,381 B2 7/2013 Streibich et al.
8,662,169 B2 3/2014 Cortez
8,685,187 B2 4/2014 Han et al.
2005/0072568 A1 4/2005 Robertson
2006/0037750 A1 2/2006 Wardlaw
2012/0006547 A1 1/2012 Robertson et al.
2012/0055666 A1 3/2012 Swor et al.
2012/0199340 A1 8/2012 Robertson
2012/0199351 A1 8/2012 Robertson
2012/0255742 A1 10/2012 Cortez
2013/0112320 A1 5/2013 Wright
2014/0034315 A1 * 2/2014 Tallini ..... E21B 29/02 166/297
2014/0137761 A1 5/2014 Robertson et al.
2014/0251612 A1 * 9/2014 Powers ..... E21B 33/1208 166/281
2014/0262249 A1 9/2014 Willberg et al.
2015/0034317 A1 2/2015 Skjold
2016/0214176 A1 7/2016 Bruck et al.
2016/0369597 A1 12/2016 Robertson et al.
2017/0241227 A1 8/2017 Tallini et al.
2018/0085850 A1 3/2018 Huang

FOREIGN PATENT DOCUMENTS

WO WO2014138444 A2 9/2014
WO WO2016069305 10/2015
WO 2016161283 A1 10/2016

OTHER PUBLICATIONS

Office Action issued in the related U.S. Appl. No. 15/275,948 dated Jul. 3, 2018 (20 Pages).
International Preliminary Report on Patentability issued in the related PCT application PCT/2015/056161, dated May 2, 2017 (12 pages).
International Search Report and Written opionion issued in the related PCT application PCT/2015/056161, dated Dec. 21, 2015 (16 pages).
Yehuda Meir and Eli Jerby, Underwater Microwave Ignition of Hydrophobic Thermite Powder Enabled by Magnetic Encapsulation, Conference: 14th International Conference on Microwave and High Frequency Heating, Nottingham, UK, Sep. 2013 (4 pages).
Extended Search Report issued in the related EP Application 17193207.2 dated May 18, 2018 (8 pages).
Exam Report issue in the related EP Application No. 17193207.2 dated Apr. 9, 2019, 6 pages.
International Search Report and Written Opinion of International Patent Application No. PCT/US2018/065590 dated Mar. 27, 2019, 13 pages.
Office Action issued in the related U.S. Appl. No. 15/275,948 dated Jun. 4, 2019, 18 pages.
Office Action issued in the related U.S. Appl. No. 15/988,098 dated Dec. 26, 2019, 40 pages.
Communication pursuant to Article 94(3) EPC issued in the related EP Application 15855623.3 dated Jan. 27, 2020, 6 pages.

* cited by examiner

NON-EXPLOSIVE DOWNHOLE PERFORATING AND CUTTING TOOLS

CROSS-REFERENCE TO RELATED APPLICATION

The present document is based on and claims priority to U.S. Provisional Application Ser. No. 62/073,929 filed 31 Oct. 2014, and U.S. Provisional Application Ser. No. 62/086,412 filed 2 Dec. 2014, and U.S. Provisional Application Ser. No. 62/090,643 filed 11 Dec. 2014, and U.S. Provisional Application Ser. No. 62/165,655 filed 22 May 2015 which are incorporated herein by reference in their entirety.

BACKGROUND

This section provides background information to facilitate a better understanding of the various aspects of the disclosure. It should be understood that the statements in this section of this document are to be read in this light, and not as admissions of prior art.

Perforating techniques have been implemented in hydrocarbon wells to create a fluid communication channel between a pay zone and the wellbore, penetrating through a casing or liner that separates the wellbore from the formation. Common tools used in perforating operations include a gun that carries shaped charges into the wellbore and a firing head which initiates detonation of the shaped charges. A detonation cord may extend from the firing head to each of the shaped charges in a gun. The shaped charges are explosive and propel a jet outwardly to form perforations in the casing or liner and into the formation.

Various techniques and tools exist for cutting pipe. Selection of a particular tool or technique may depend on the type of pipe, the location of the pipe, as well as the ambient conditions surrounding the pipe. In the production of hydrocarbon fluids, such as oil and natural gas, wells may be drilled into which pipes, tools, and other items may be run. Occasionally, to enable at least partial removal of the pipes, tools, and other items, cutters may be deployed. Conventionally, two types of specially designed cutters have been employed: a jet cutter which projects a force from an explosion to cut the items, and a chemical cutter which may project a caustic acid to cut through the items. Use of these types of cutters, however, is limited due to high pressure and high temperature constraints.

SUMMARY

In accordance with an embodiment a non-explosive downhole tool for creating openings in tubulars includes a carrier holding a non-explosive material, such as thermate, a head connected with the carrier and having a port to eject a product of the ignited material from the head and a communication path extending from the material to the port and a moveable member in a closed position blocking the communication path and in an open position opening the communication path. An example of a method of creating an opening in a tubular includes disposing a non-explosive tool in a tubular that is disposed in a wellbore, igniting a thermate material in the tool and displacing a moveable member in response to a product (e.g., gas and or molten material) produced by the ignited thermate material thereby opening a port in the tool and directing the product through the port and onto the tubular thereby creating an opening in the tubular. A non-explosive downhole tubular cutter in accordance to an embodiment includes a carrier body holding a thermate material, a head connected to carrier body that has a diverter section that is axially moveable relative to a diverter section from a closed position in contact with the diverter section to an open position forming a 360 degree port between the axially separated body and diverter section in response to ignition of the thermate material and a channel extending through the diverter section from the thermate material to the port.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
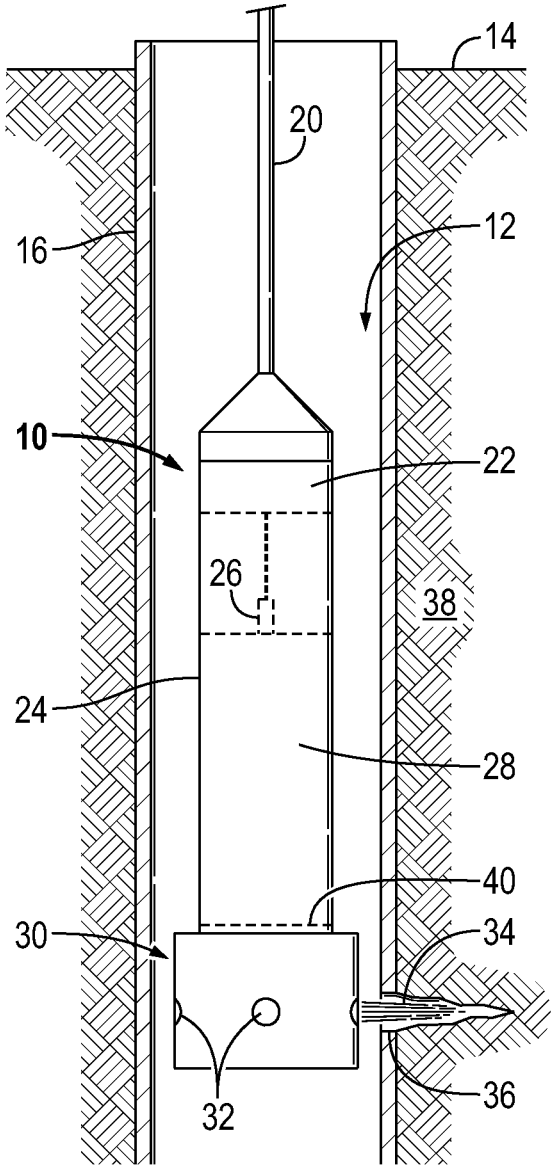
FIGS. 1 and 1A illustrate a non-explosive downhole tool arranged in a perforating or puncher configuration according to one or more aspects of the disclosure disposed in a wellbore.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms connect, connection, connected, in connection with, and connecting may be used to mean in direct connection with or in connection with via one or more elements. Similarly, the terms couple, coupling, coupled, coupled together, and coupled with may be used to mean directly coupled together or coupled together via one or more elements. Terms such as up, down, top and bottom and other like terms indicating relative positions to a given point or element are may be utilized to more clearly describe some elements. Commonly, these terms relate to a reference point such as the surface from which drilling operations are initiated.

Further, as used herein, "thermite" may refer to composition that includes a metal powder fuel and a metal oxide which when ignited produces an exothermic reaction. For example, in some embodiments, the thermite may take the form of a mixture of aluminum powder, and a powdered iron oxide. As used herein, "thermate" may refer to a thermite with metal nitrate additives. In some embodiments, a metal carbonate may be added instead of or in addition to the nitrate. For example, a thermate may take the form of aluminum powder, a powdered iron oxide, and barium nitrate. It should be appreciated that for both the thermate and thermite compositions, various different materials may be implemented other than the examples noted.

Generally, tools and techniques for forming perforations in and through casing, cement, formation rock and cutting tubulars in downhole conditions under high pressure are disclosed. The downhole tool may take the form of a thermate perforating or cutting tool that operates by directing gas at high temperatures (e.g., approximately 2500-3500 degrees C. or higher) towards objects to be perforated or cut. The gas is thrust outwardly from the tool under pressure and may melt, burn and/or break the objects to be cut or perforated. In accordance to embodiments, the energy source material produces a gas to thrust molten metal from the tool to create the desired perforation or cutting opening.

In some embodiments, the tool may be used in a perforating gun or on a perforating tool string for perforating operations. In some embodiments, the tool may replace a perforating gun in a perforating string. The tool may be ignited at the same time as a perforating gun or at a different time from the perforating gun. Additionally, it should be appreciated, that the tool may be deployed independent from a tool string or a perforating string and may be conveyed downhole via any suitable conveyance (e.g., tubing string, wireline, coiled tubing, and so on). The downhole tool is both concise and reliable under high pressures and it may use the downhole wellbore pressure to help seal the tool. Additionally, once the tool is open, it will not trap pressure.

Figure 1A:
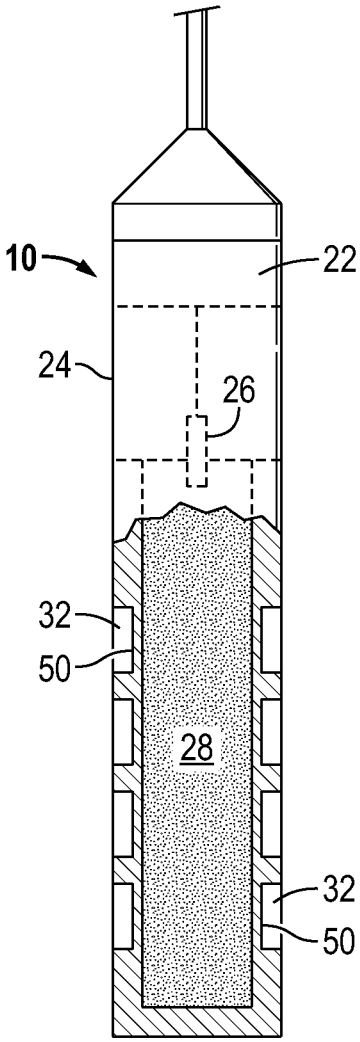
Figure 2:
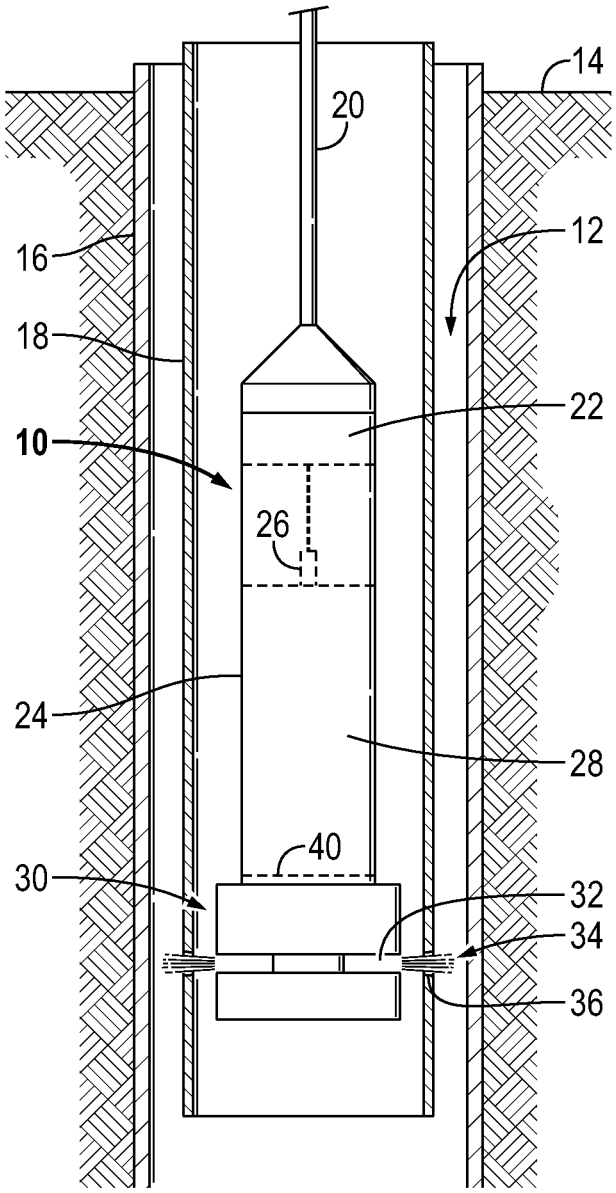
FIGS. 2 and 2A illustrate a non-explosive downhole tool arranged in a cutter configuration according to one or more aspects of the disclosure disposed in a wellbore.
Figure 2A:
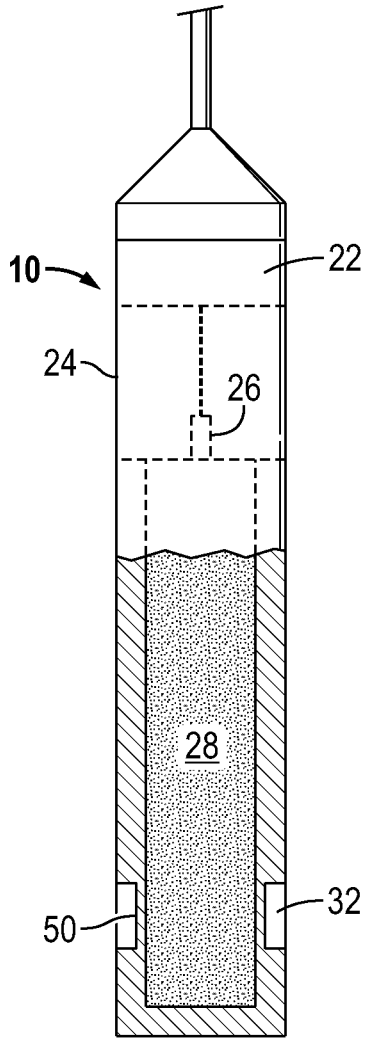

FIGS. 1 and 1A illustrate non-exclusive examples of a non-explosive downhole tool 10 arranged in a perforating or puncher configuration deployed in a wellbore 12 (i.e., borehole, well) extending from a surface 14. FIGS. 2 and 2A illustrate non-exclusive examples of a non-explosive downhole tool 10 arranged in a cutter configuration deployed in a wellbore 12. The wellbore 12 may be lined with casing 16. In FIG. 2, a tubular such as a tubing string 18 is deployed in the wellbore inside of the outer casing 16. The downhole tool 10 is illustrated deployed in the wellbore on a conveyance 20, such as and without limitation, wireline and tubing.

With reference to FIGS. 1, 1A, 2 and 2A, the non-explosive downhole tool 10 generally includes a firing head 22, a housing or carrier body 24, an igniter 26 (e.g., a thermal generator) in operational contact with a non-explosive energy source 28, and one or more ports 32 (e.g., ejection or discharge ports) for emitting a product 34 (e.g., hot gas and or molten material) jet of the ignited energy source 28 to create openings 36 (i.e., perforations, cuts, etc.) in one or more of the surrounding tubulars 16, 18 and the surrounding formation 38. In FIG. 1 the non-explosive downhole tool 10 is utilized to create and opening 36 through the casing 16 and extending into the surrounding formation 38. When used as a puncher, the opening may be only created through an inner tubular, such as a tubing string. In a perforating or puncher configuration as illustrated by way of example in FIGS. 1 and 1A, one or more ports 32 are selectively in communication with the energy source 28 and arranged in a circumferential and/or axial pattern. In a cutting configuration as illustrated by way of example in FIGS. 2 and 2A, a single port 32 is selectively in communication with the energy source 28 and the single port is a 360 degree or substantially a 360 degree circumferential opening formed about the tool so that the jet cuts the surrounding tubular as illustrated in FIG. 2. In accordance to some embodiments, a cutting configuration may have multiple ports 32 spaced circumferentially in a manner to create a cutting type of opening 36.

In accordance with embodiments the ports 32 may be selectively in communication with the energy source 28, for example closed until the energy source 28 is ignited. In FIGS. 1A and 2A a holding element, generally identified with the numeral 50, is illustrated that may maintain the ports 32 in a closed or blocked position until the energy source 28 is ignited. In the examples of FIGS. 1A and 2A the holding element 50 is in the form of a thin, or a weakened wall portion of the carrier body, or constructed of a material having a lower melting temperature than the carrier body 24. Accordingly, ignition of the energy source 28 will melt or otherwise eliminate or operate the holding element 50 to an open position. Other types of holding elements may be utilized with reference to the tool 10 of FIGS. 1A and 2A.

In the embodiments depicted in FIGS. 1 and 2 the ports 32 are provided with a head 30, which may be referred to as a penetrator head. The penetrator head 30 may be an independent element attached to the carrier body 24 at a joint 40 for example by threading or welding. In some embodiments, the penetrator head 30 and the carrier body may be portions of a unitary tool body.

In some embodiments, the carrier body 24 may be smaller than the penetrator head 30. In some cases, the downhole tool 10 may be utilized to cut or perforate a large diameter tubular (e.g., casing) and the penetrator head 30 may be configured and dimensioned to place the head in close proximity to the tubular whereas the carrier body 24 may remain a standard size. For example, if a 7 inch tubular (e.g., casing) is to be cut or perforated, a 6 inch penetrator head 30 may be coupled to a 3.5 inch carrier body 24. In another example, if a 9⅝ inch tubular is to be cut or perforated, an 8⅝ inch penetrator head 30 may be coupled with a 3.5 inch carrier body 24. The weight of the downhole tool 10 may thus be reduced. It should be appreciated that although the penetrator head 30 is illustrated as being on the bottom of the tool 10, it may be positioned at the top or any other suitable location. It will also be recognized by those skilled in the art with benefit of this disclosure that multiple penetrator heads 30 may be installed sequentially, for example to provide a perforating cluster.

In accordance with one or more embodiments, the energy source 28 is a thermate material and it may take any suitable form and in some embodiments may take the form of a powder, or powder pellets. Table 1 sets forth various possible constituent parts that may be used to create the thermate material for use in the tool. The powders may generally be a fine powder and the sensitivity of the mixture may depend upon the powder mesh size. As the mesh size decreases, the sensitivity increases. In some embodiments, a slight over supply of metal fuel may be provided than theoretically calculated. In some embodiments, the thermate material may contain between approximately 3-7 percent or more of thermite powder (e.g., approximately 5% 10%, 15%, 20% or more) and either approximately 3-7% or more (e.g., approximately 5%, 10%, 15%, 20% or more) or metal carbonate or metal nitrate. The additives for binding, for example as listed in Table 1, may be in powder form or any other suitable form.

TABLE 1

| Metal Fuel | Metal oxide | Metal Carbonate | Metal Nitrate | Powder Additives |
|---|---|---|---|---|
| Al, Be, Ti, Ta, Y, Zr, Zn, Fe, Mg, Si | Bi2O3, CoO, Co3O4, Cr2O3, CuO, Cu2O, Fe2O3, Fe3O4, I2O5, MnO2, NiO, Ni2O3, PbO2, PbO, Pb3O4, SnO2, WO2, WO3 | BaCO3, CaCO3, MgCO3, K2CO3, Li2CO3, SrCO3, | Ba(NO3)2, Ca(NO3)2, LiNO3 KNO3, Mg(NO3)2, Sr(NO3)2, | Epoxy, Polymer, Starch |

The energy source or material 28, e.g., a thermate material, may be referred to as the pyrotechnic or energetic material. The nitrates and/or carbonates produce gas to drive molten metal, i.e., product 34, out of the ports 32 to create the opening(s) 36 in the surrounding elements. Upon ignition, the metal fuel reacts with the metal oxide exchanging the metal in the metal oxide, while releasing heat sufficient to melt the metal. Additionally, the metal carbonate or metal nitrate decomposes into metal or metal oxide and gas. For example, the reaction of aluminum and iron oxide, and the decomposition of Strontium nitrate are shown below. The reaction for other compositions listed in Table 1 is similar to that shown below. The reactants of oxygen can also burn aluminum or other materials.

$$8AL+3Fe3O4 \rightarrow 4AL2O3+9Fe$$

$$Sr(NO3)2 \rightarrow SR+2NO2+O2$$

The chemical reactions produce high temperatures (e.g., above approximately 2500 degrees C. in some cases, such as above approximately 3000 degrees C.). In a closed chamber, e.g., one mole, 211 grams of Strontium nitrate offers, 3 moles of gas which can effectively raise the pressure inside the carrier body 24. The molten metal may be broken down into fine drops in the high pressure and high temperature environment and a product jet 34 of high temperature gas with the molten metal is pushed out by the pressure to perform the cutting or perforating. The molten metal may exit the tool 10 under pressure by gas jets shooting through ports 32 in the tool. In some embodiments, the ports may be exposed upon formation of gas inside. The product 34 increases the pressure inside the tool to force open the ports or translate a part of the tool to open the ports. Accordingly, communication between the ports 32 and the energy source 28 may be blocked prior to ignition of the energy source 28. For example, hydraulic communication may be blocked between the ports 32 and the energy source 28 to seal the unignited energy source 28 from the wellbore environment and fluids.

The igniter 26 may take any suitable form (e.g., electric, chemical) and in one embodiment may take the form of an exploding bridgewire (EBW). The EBW igniter may be one marketed and sold by Teledyne, Inc., for example an SQ-80 igniter which is a thermite filled exploding bridgewire igniter. The EBW ignites the thermite in the igniter and ignites the energy source 28, e.g., thermate material. In some embodiments, the igniter 26 may be provided in multiple parts. For example, the igniter 26 may be provided in two parts, for example the EBW and a thermite pocket, and the parts may remain separated until the downhole tool 10 is ready to be used at a field site.

Other examples of igniters 26 include without limitation, electrical spark and electrical match igniters that are in contact with the energy source 28 or in contact with a thermite material and chemical igniters. Additionally, the igniter 26 may be positioned at any suitable position within the carrier body 24. For example, the igniter 26 may be positioned at or near the top, at or near the bottom, or any position in the middle and in contact with the energy source 28. If the igniter 26 is not embedded in the energy source material or within a distance to ignite the energy source then it may be connected by a fuse cord utilizing a non-explosive energetic material such as thermite or thermate. A fuse cord may also be utilized to connect multiple tools 10 to fire in sequence. For example with reference to FIG. 1, a tool string may include more than one energy source 28 and penetrator head 30 section. An example of a fuse cord according to embodiments disclosed herein is further described below with reference to FIG. 22 below.

The openings 36 in the surrounding elements are created by the product 34 jet flowing out of the tool 10 through the ports 32. The temperature of the product 34 may be high enough to change the steel of the surrounding tubulars from a solid phase to a liquid and possibly to a gas, while the oxygen in product 34 assists in burning the metal alloys. When perforating, the openings 36 may extend into the formation similar to an explosive shaped charge jet.

Figure 3:
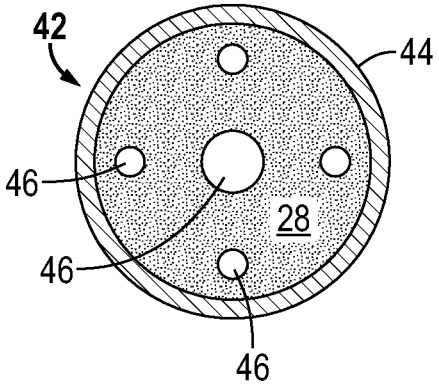
FIGS. 3 and 4 illustrate an embodiment of a non-explosive energy source in the form of a thermate pellet according to one or more aspects of the disclosure.
Figure 4:
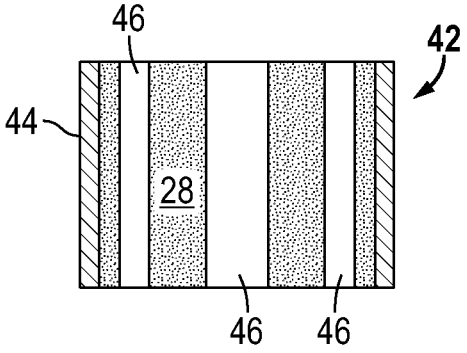

With reference to FIGS. 3 and 4, an energy source 28 is formed as pellets 42, for example thermate powder pellets. Pellets 42 maybe formed by pressing thermate material 28 into a thin wall tube 44. The tube 44 can be made of any suitable material such as plastic, cardboard, metal, and so forth. FIG. 4 illustrates a top view of a pellet 42 in accordance with an example embodiment. Various pellet shapes can be used to achieve a suitable burn at a desired burn rate. In some embodiments, the pellets 42 may have one more holes 46. The holes 46 may be located at or near the center, or they may be distributed around the pellets 42 with or without a center hole.

With reference to FIGS. 5, 6 and 8 to 10 embodiments of a penetrator head 30 arranged in a cutter or cutting configuration with a port 32 formed as a 360 degree circumferential opening are illustrated.

Figure 5:
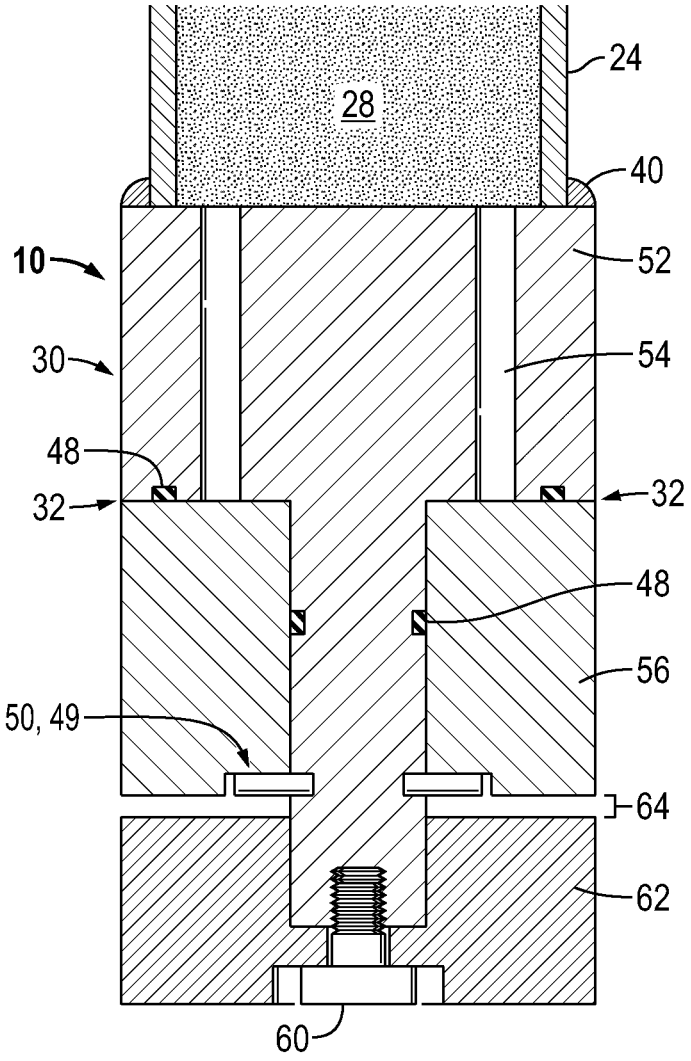
FIGS. 5 and 6 illustrate a non-explosive downhole tool having a penetrator head arranged in a cutter configuration according to one or more aspects of the disclosure.
Figure 6:
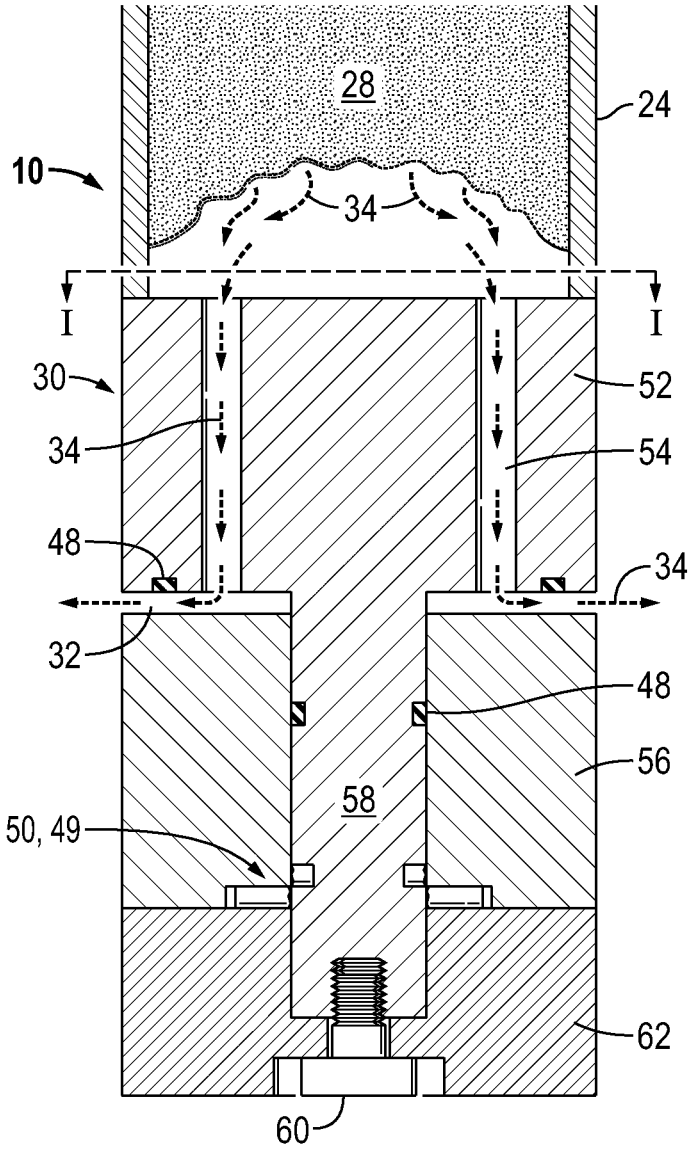

Refer now to FIGS. 5 and 6 illustrating a non-explosive downhole tool 10 having a penetrator head 30 in accordance to one or more embodiments. In FIG. 5, penetrator head 30 is shown in a closed, or pre-ignition, position with communication blocked through port 32 between the external environment and energy source 28 for example by seals 48 (i.e., seal elements). FIG. 6 illustrates the ejection port 32 opened and the hot product 34 jet of gas and molten metal being ejected from the penetrator head 30 in response to ignition of the energy source 28. Port 32 is maintained in a closed position by a holding element, generally identified with reference number 50. As will be understood by those skilled in the art with reference to this disclosure the holding element may take various forms and configurations. With additional reference to FIGS. 1 and 2, the port 32 is opened in response to the pressure of the gasses produced by ignition of the energy source 28 overcoming the pressure in the external environment, i.e., the wellbore 12 pressure, acting on the moveable body 56 and a preloaded force which is provided in FIGS. 5, 6 and 8 by the holding element 50 which is depicted as shear element (e.g., pin, screw) which identified specifically with the reference number 49.

Figure 7:
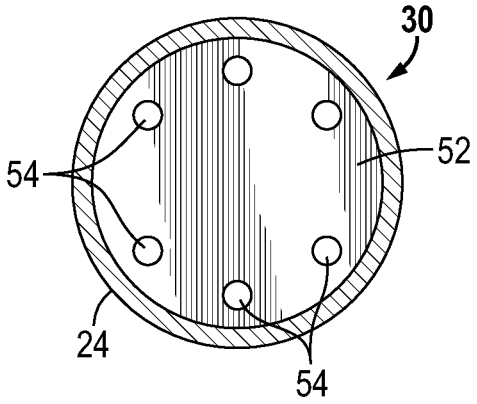
FIG. 7 illustrates a diverter section of a penetrator head in accordance to one or more aspects of the disclosure along a line I-I of FIG. 6.

The penetrator head 30 illustrated in FIGS. 5, 6 and 8 to 10 include a diverter section 52 having one or more vents or channels 54 providing a communication path between energy source 28 and ejection port 32. FIG. 7 illustrates a sectional view of a diverter section 52 of penetrator head 30 along the line I-I of FIG. 6.

Port 32 is formed between the diverter section 52 and a moveable body 56 (e.g., cutter body) which is disposed with a shaft 58 and moveable relative to diverter section 52. Moveable body 56 is held in the closed position relative to the diverter section 52 by the holding element 50. In the embodiment of FIGS. 5 and 6, moveable body 56 moves relative to or on shaft 58. In FIGS. 5 and 6 the holding element 50 is a shear member oriented generally perpendicular to the longitudinal axis of the tool and attached to the shaft 58 and the moveable body is located between the shear element 50 and the diverter section.

Figure 8:
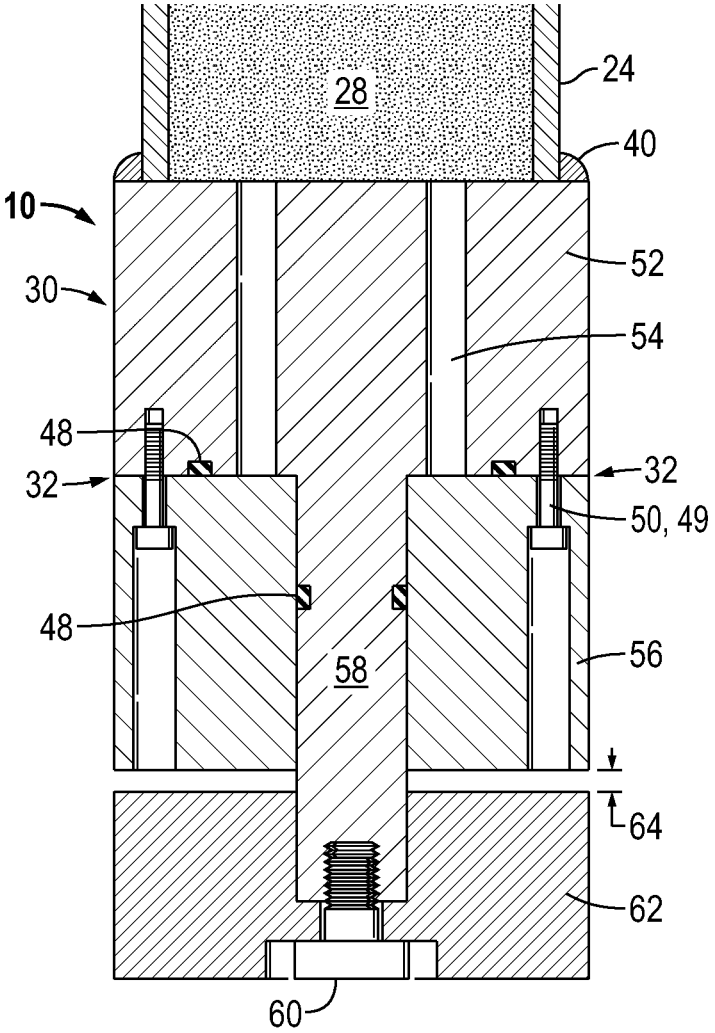
FIG. 8 illustrates a penetrator head arranged in a cutter configuration according to one or more aspects of the disclosure.

With reference to FIGS. 5, 6 and 8 to 10 a retaining member 60 is located, for example connected to shaft 58, to maintain moveable body 56 in connection with the diverter section 52 when the port 32 has been opened. In FIGS. 5, 6 and 8 retaining member 60 is depicted as a lug connected to shaft 58 and positioning a retaining base 62. As will be understood by those skilled in the art with benefit of this disclosure, the retaining member 60 and retaining base 62 may be a single, unitary member, and or the retaining member 60 may directly connect the moveable body 56 with the shaft 58.

The size of the ejection port 32 in accordance to embodiments is determined by the distance the moveable body 56 moves relative to the diverter section 52 upon actuation to the open position. For example, in the embodiments of FIGS. 5 and 8, the penetrator head 30 is shown in a closed position with a gap 64 formed between the moveable body 56 and the retaining member base that is equivalent to the size of port 32 when open as illustrated for example in FIG. 6.

FIG. 8 illustrates a penetrator head 30 in a cutting configuration utilizing a holding element 50, in the form of a shear member 49 (e.g., pin or screw), directly connecting the moveable body 56 with diverter section 52 when in the closed position. Moveable body 56 is disposed with and moveable along shaft 58 in this example.

With reference to FIGS. 2 and 5-8, upon activation of igniter 26 the energy source 28, e.g., thermate material, is ignited producing high temperature and pressure product 34 (gas and/or molten metal) which is communicated through diverter channels 54 and against moveable body 56. When the force of the high pressure gas acting on moveable body 56 overcomes the force of the shear element and the wellbore pressure acting on the moveable body 56, the shear element parts and releases moveable body 56 to move relative to diverter section 52 thereby opening port 32. As will be understood by those skilled in the art with benefit of this disclosure, holding element 50 may be replaced with a device other than a shear element.

Figure 9:
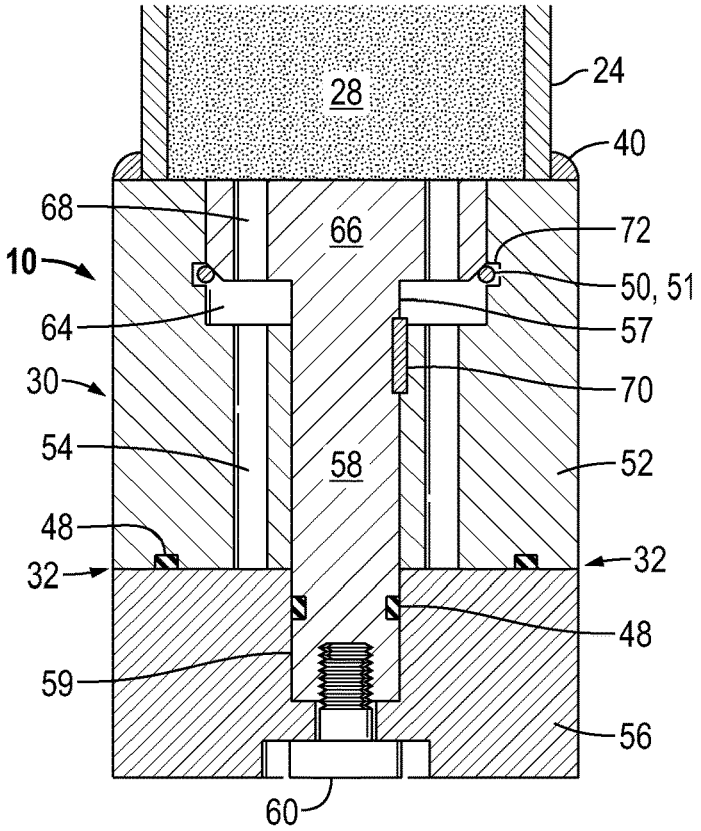
FIGS. 9 and 10 illustrate non-explosive downhole tool with penetrator heads arranged in a cutter configuration according to one or more aspects of the disclosure.
Figure 10:
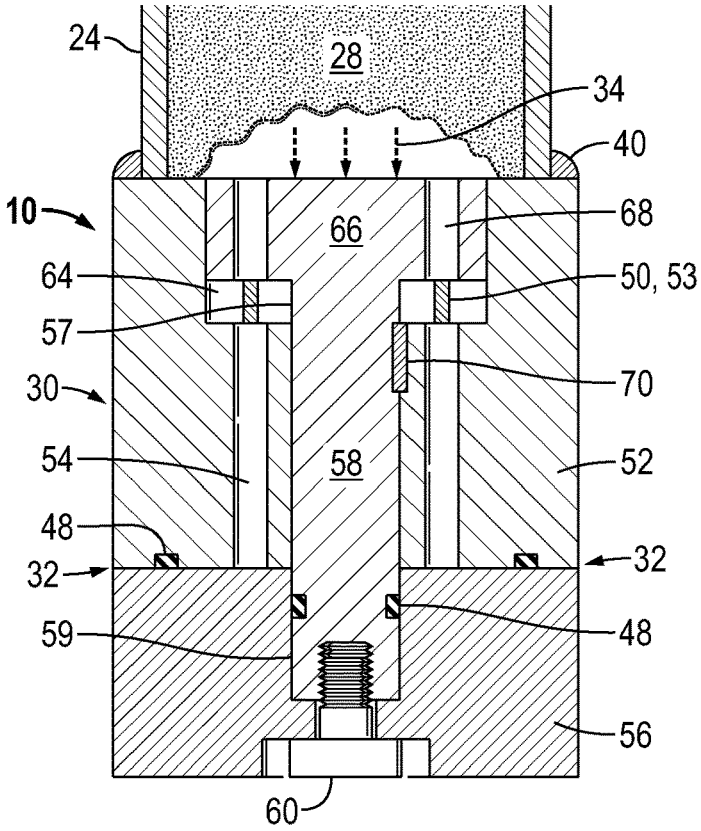

Referring now to FIGS. 9 and 10 a penetrator head 30 is illustrated in a cutter configuration in which the moveable body 56 moves with shaft 58 relative to the diverter section 52. Shaft 58 extends through the diverter section 52 and has a piston head 66 connected to a first or top end 57 and the retaining member 60 and moveable body 56 connected proximate to the bottom end 59. Piston head 66 includes one or more pathways 68 to communicate the gasses produced from the ignition of the energy source 28. The pathways 68 are depicted aligned with the diverter channels 54 of the diverter section 52 for example with an anti-rotation element 70 connected between the diverter section and the piston head 66.

In FIG. 9 the moveable body 56 is maintained in the closed position by a holding element 50 in the form of a ring 51 (e.g., C-ring) which is operationally connected between the piston head 66 and the diverter section 52. An axial gap 64 is provided between piston head 66 and the diverter section 52 when the moveable body is in the closed position corresponding to the size of the ejection port 32 when it is opened. Ignition of the energy source 28 creates high pressure gas which acts on piston head 66 and urging it axially downward away from the energy source 28. When the downward force of piston head 66 overcomes the opposing force of the external pressure acting on the moveable body 56 and the force of holding element 50, moveable body 56 moves opening port 32 and allowing the high temperature and high pressure gas to be ejected to cut, perforate or otherwise create openings. In this example, the energy source pressure acting on piston head 66 expands the holding element 50 into a recess 72 of the diverter section allowing the piston head 66 and moveable body 56 to move.

In FIG. 10 the holding element 50 is in the form of a dissipating element 53, e.g., a burn element. Dissipating element 53 dissolves, melts, deforms or otherwise dissipates to allow the moveable body 56 to move from the closed to an open position. For example, in FIG. 10 the dissipating element 53 is in the form of a standoff member, e.g, a cylindrical member or ring, disposed between the piston head 66 and the diverter section 52. Dissipating element 53 is formed of a material that melts, burns, deforms or otherwise degrades when exposed to the temperature and oxygen of the gas (product 34) produced by the ignited energy source 28 which is greater than the temperature of the environmental temperature. Accordingly, upon ignition of the energy material 28 the preload force of the dissipating element 53 is eliminated by the destruction or degradation of the dissipating element. When the force of the pressure of the product 34 acting on piston head 66 overcomes the force of the environmental pressure acting on the moveable body 56, the moveable body is displaced thereby opening the communication path between the thermate material the ejection port 32.

Figure 11:
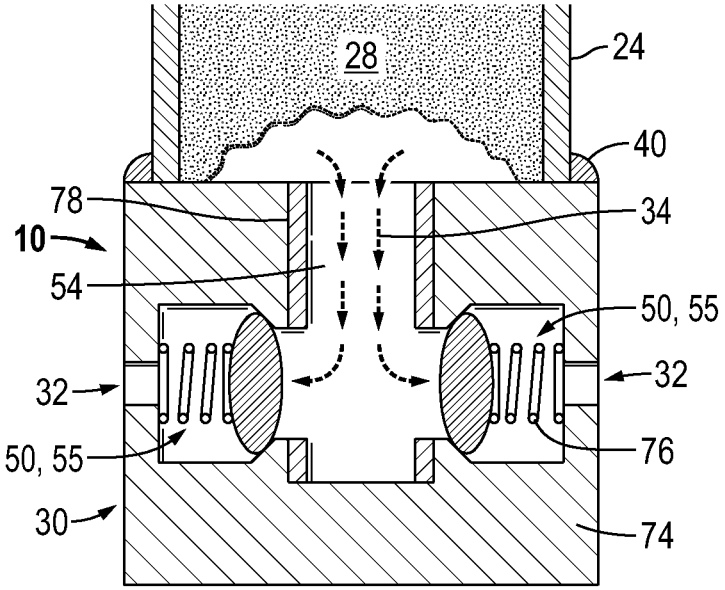
FIGS. 11 to 13 illustrate non-explosive downhole tools utilizing one-way check devices in the penetrator head according to one or more aspects of the disclosure.
Figure 12:
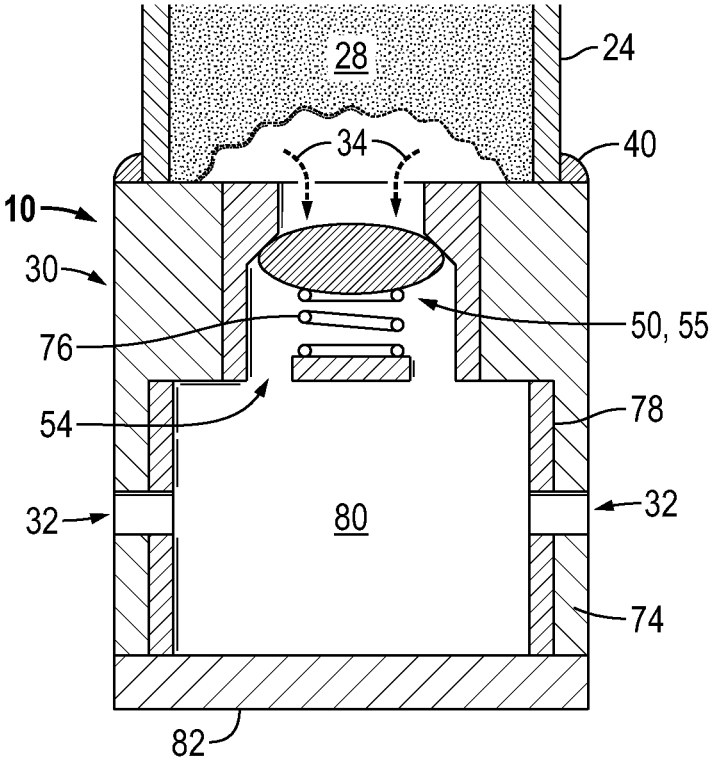
Figure 13:
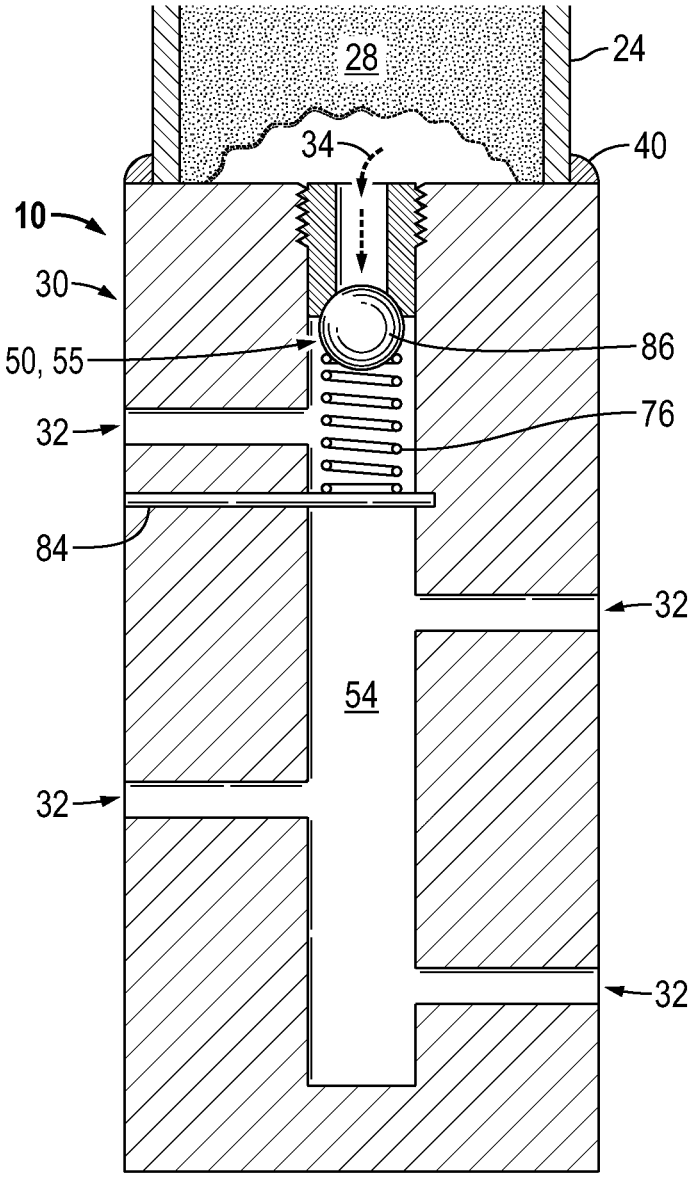

Refer now to FIGS. 11 to 13 illustrating additional embodiments of non-explosive downhole tools 10. The penetrator heads 30 in FIGS. 11 to 13 may be utilized in a perforating or a cutting configuration. Penetrator head 30 is connected to a carrier body 24 at a joint 40. Penetrator head 30 includes a body 74 that forms one or more ports 32 for ejecting the gas produced by the ignited energy source 28. Ports 32 are oriented radially relative to the longitudinal axis of the tool 10. The one or more ports 32 are selectively in communication with the energy source 28 through a channel 54 (e.g., a diverter channel). A holding element generally denoted by the numeral 50, maintains the ports 32 in the closed position. In the embodiments of FIGS. 11 to 13, the holding element 50 is illustrated in the form of one-way valves (i.e., check valves) which are specifically identified with reference number 55. The one-way valves 55 are oriented to permit the product 34 produced from ignition of energy source 28 to pass from the carrier body 24 through the communication path to the ejection ports 32 and to seal the energy source 28 from hydraulic communication in the direction from the environment through the ejection port 32 and communication path to the thermate. Accordingly, the one-way valves 55 (i.e., moveable member, or valve member 86 (FIG. 13)) are biased with a preload force to the closed position for example by a biasing element 76 at the surface ambient conditions. When deployed in a wellbore (FIGS. 1 and 2), the wellbore pressure will reinforce the sealing of the one-way valves. The one-way valves remain closed until the pressurized product of the ignited energy source 28 overcomes the preload force on the check valve and the environmental pressure. In accordance to some embodiments the body 74 may be constructed of steel and the inner chambers, such as channel 54 (e.g., communication path), may include an inner layer or sleeve 78 constructed of a material having a high melting point to withstand the high temperatures of the product 34. For example, the inner sleeve 78 may be constructed of materials such as and without limitation to ceramics, graphite, carbon fiber, molybdenum, tantalum, and tungsten. The inner layer 78 may be located proximate the ports 32 so that the ports 32 maintain their size to provide a focused product jet 34. The size of the ports 32 may dictate the performance of the penetrator head 30. In accordance to an embodiment, the ports 32 may have a diameter less than about one-inch in diameter. In accordance to some embodiments, the ports 32 may be less than about one-half inch in diameter.

With reference to FIG. 11, a one-way valve 55 is positioned in the communication path between each individual port 32 and the energy source 28. In the depicted example the one-way valves 55 seal the diverting channel 54 from the external environment until opened.

With reference to FIG. 12, the holding element 50 is in the form of a single one-way valve 55 positioned in the channel 54 between the energy source 28 and all of the ports 32. In this example, the portion of the channel 54 downstream of the one-way valve 55 may be enclosed and referred to as a chamber or reservoir 80. The ports 32 are in communication with the reservoir 80 portion of the channel 54. The reservoir 80 is enclosed so that the hot gas is ejected through the ports 32. The inner layer 78 of high melting point material may maintain the integrity of the port 32 sizes. The bottom end 82 of the body 74 closing the reservoir 80 may include an inner layer 78 of high melting point material or be constructed of a high melting point material.

FIG. 13 illustrates a penetrator head 30 in a perforating configuration with multiple ports 32 oriented in a radial direction from the longitudinal axis of the tool 10 and spaced circumferentially and axially about the penetrator head 30 for example in a spiral pattern. The one-way valve 55 is located in the channel 54 upstream of all of the ports 32. As will be understood by those skilled in the art with benefit of the disclosure the one-way valve may be arranged in various configurations. In the depicted example, the biasing member 76 may be supported in the channel 54, or the flow path of channel 54, by a pin hole 84 such that when the high pressure product 34 moves the valve element 86 off of the valve seat the product 34 and any molten material can flow around the valve element 86 and biasing element and eject out of the ports 32. The channel 54 may be constructed of or lined with a high melting point temperature for example to maintain the size of the ports 32.

Refer now to FIGS. 14 to 19 illustrating embodiments of a non-explosive downhole tool 10 utilizing a shifting piston 88 to selectively open the ports 32 of the penetrator head 30 to eject high pressure product 34 from the ignition of energy source 28. The penetrator head 30 may be arranged in a perforating configuration or in a cutter configuration, for example, with multiple ports arranged to create a substantially 360 degree opening about the penetrator head.

In the depicted embodiments the penetrator head 30 includes a body 74 forming a longitudinally extending cylinder 90 extending from a top end 89 to a bottom end 91. The shifting piston 88 is moveably disposed in the cylinder 90. The shifting piston 88 may include a seal 48 (sealing element), for example an O-ring, to provide a hydraulic seal between the shifting piston and the cylinder wall. One or more radially extending ports 32 are formed through the body 74 between the cylinder 90 and the external environment. Although not specifically illustrated in FIGS. 14 to 19 the cylinder 90 may constructed of or include an inner layer of a high melting material such as described with reference to FIGS. 11 and 12.

The top end 89 of the cylinder is in communication with the energy source 28 in the carrier body 24 for example through channels 54 for example formed through a diverter section 52 of the body 74. In the closed position the shifting piston 88 is located toward the top end 89 of the cylinder 90 such that the seal 48 is positioned energy source 28 and the downstream ports 32. The bottom end 91 of the cylinder 90 is in communication with the external environment so that shifting piston 88 can move within cylinder 90. Shifting piston 88 and thus ports 32 are maintained in a closed position by a holding element generally identified with reference number 50.

Figure 15:
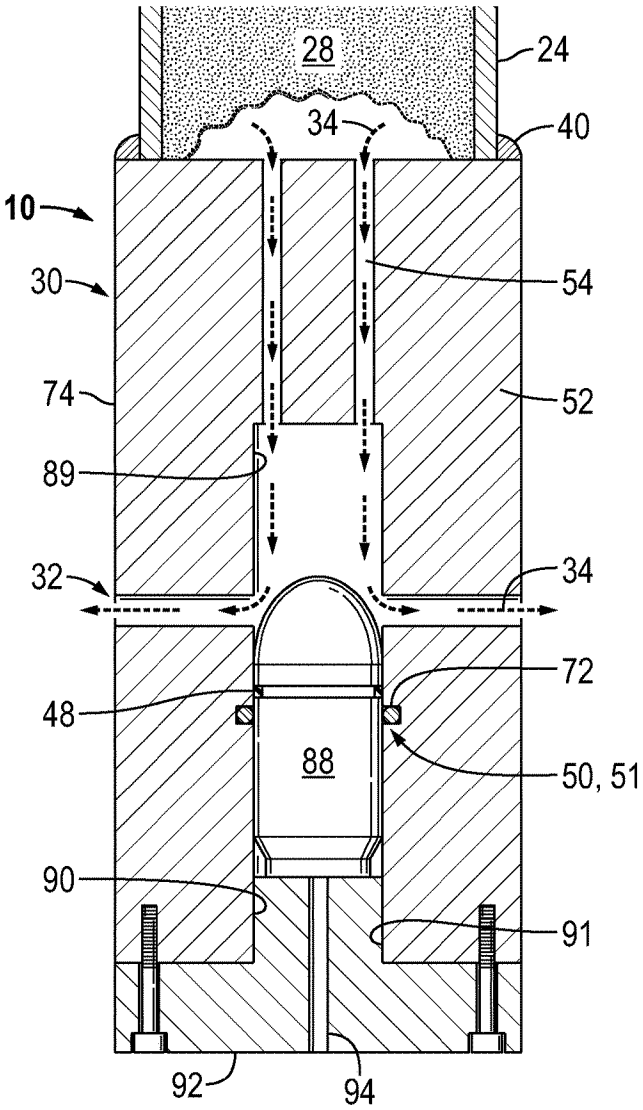
FIGS. 14 to 19 illustrate non-explosive downhole tools utilizing a shifting piston disposed in a cylinder of a penetrator head to selectively open ejection ports according to one or more aspects of the disclosure.
Figure 14:
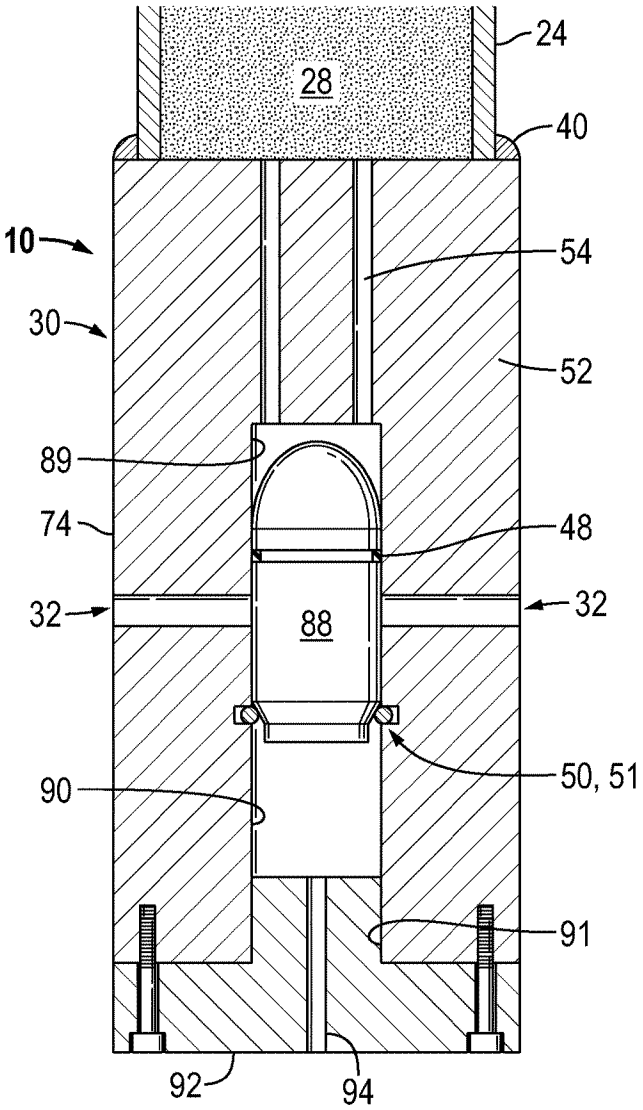

Referring now to FIGS. 14 and 15 in which the holding element 50 is in the form of a ring 51 (e.g., C-ring) which is operationally connected between the shifting piston 88 and the wall (body 74) of the cylinder 90. In FIG. 14, shifting piston 88 is in the closed position located adjacent to the top end 89 of the cylinder and providing a hydraulic seal, across seal element 48, between the ports 32 and the communication channel(s) 54 to the energy source 28. In FIG. 15 the energy source 28, e.g. thermate material, has been ignited producing a hot pressurized product 34 that acts on shifting piston 88 and has shifted the shifting piston 88 to the open position with the seal 48 located downstream of the ports 32 relative to the channels 54. To displace the shifting piston 88 the force of the product 34 acting on shifting piston 88 must overcome the force of the environmental pressure, for example the wellbore pressure in FIGS. 1 and 2, acting on the shifting piston 88 and the force required to release holding element 50. In this example, the preloaded holding force is released upon expanding ring 51 into the recess 72 in the cylinder wall. In FIGS. 14 and 15, a base element 92 is positioned at the bottom end 91 of the cylinder 90 to hold the shifting piston 88 in the cylinder after it has been moved to the open position. A vent 94 provides hydraulic communication between the bottom end of the cylinder and the external environment.

Figure 16:
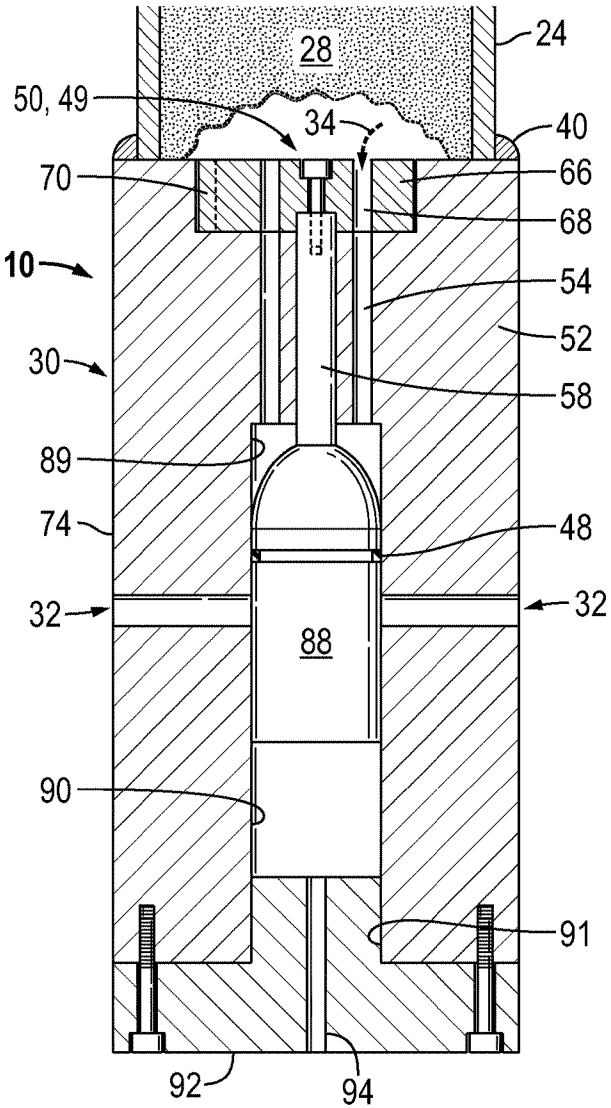

FIG. 16 illustrates another embodiment of a downhole tool 10 and penetrator head 30. In this embodiment, shifting piston 88 is maintained in the closed position by a holding element 50 in the form a shear member 49. In this example a shear member 49 is connected to the shifting piston 88 through a shaft 58 which extends through the diverter section 52 of the body 74. For example, shifting piston 88 may be disposed in cylinder 90 into a closed position with the seal 48 located upstream of the ports 32 and the shaft extending through the diverter section 52 to the top of the penetrator head. The shear element 49 may then connect the shaft and the shifting piston in the closed position. For example, in FIG. 16 a piston head 66 with pathways 68 is positioned at the top end of the body 74 and connected to shaft 58 via the shear element 49. The penetrator head 30 can then be connected to the carrier body 24. After the shifting piston 88 is located in the cylinder a base element 92, with a vent 94, may be connected to block the bottom end 91 of the cylinder to contain the shifting piston when it is released from the shear element 49. An anti-rotation member 70 is depicted connecting piston head 66 with body 74 such that the pathways 68 are aligned and in communication with the channels 54. With reference to FIGS. 1 and 2, downhole tool 10 is disposed in a wellbore in a closed position as illustrated in FIG. 16. Upon ignition of the energy source 28 a hot and high pressure product 34 is produced and communicated through channels 54 to cylinder 90 exert a downward force on the shifting piston. When the downward force overcomes the force from the wellbore pressure acting on the shifting piston and the preload force of the shear member 49 (i.e., holding element 50) the shear member is parted and the shifting piston moves to an open position allowing the high pressure product 34 to be ejected out of the ports 32 to create an opening 36 for example in the form of perforations or a cut.

Figure 17:
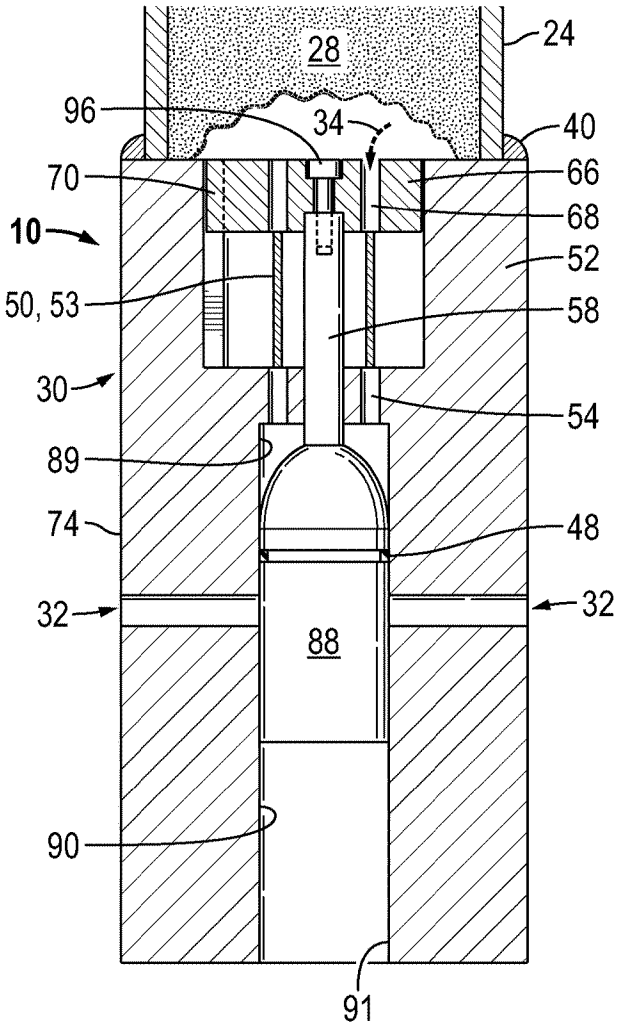

FIG. 17 illustrates a downhole tool 10 and penetrator head 30 utilizing a holding element 50 in the form of a dissipating element 53 to selectively maintain the shifting piston 88 in a closed position with a preloaded force. Similar to FIGS. 10 and 16, a piston head 66 is located above the diverter section 52 and connected to the shifting piston 88 by a shaft 58. An anti-rotation member 70 may maintain pathways 68 of the piston head 66 aligned with the diverter channels 54.

Dissipating element 53 dissolves, melts, deforms or otherwise dissipates to allow the moveable body 56 to move from the closed to an open position. For example, in FIG. 16 the dissipating element 53 is in the form of a standoff member disposed between the piston head 66 and the diverter section 52 of the body 74. Dissipating element 53 is formed of a material that melts or deforms when exposed to the temperature of the product 34 produced by the ignited energy source 28 which is greater than the temperature of the environmental temperature. Accordingly, upon ignition of the energy material 28 the preload force of the dissipating element 53 is eliminated by the destruction, or deformation, of the dissipating element. When the force of the pressure of the product 34 acting on the shifting piston and piston head overcomes the force of the environmental pressure action on the shifting piston 88, the shifting piston is moved to the open position with the seal 48 downstream of ports 32. In FIG. 17, the bottom end 91 is illustrated as open as the shifting piston 88 is held in the cylinder by the connection of the shifting piston to the piston head 66 for example by a connector 96, for example a bolt.

Figure 19:
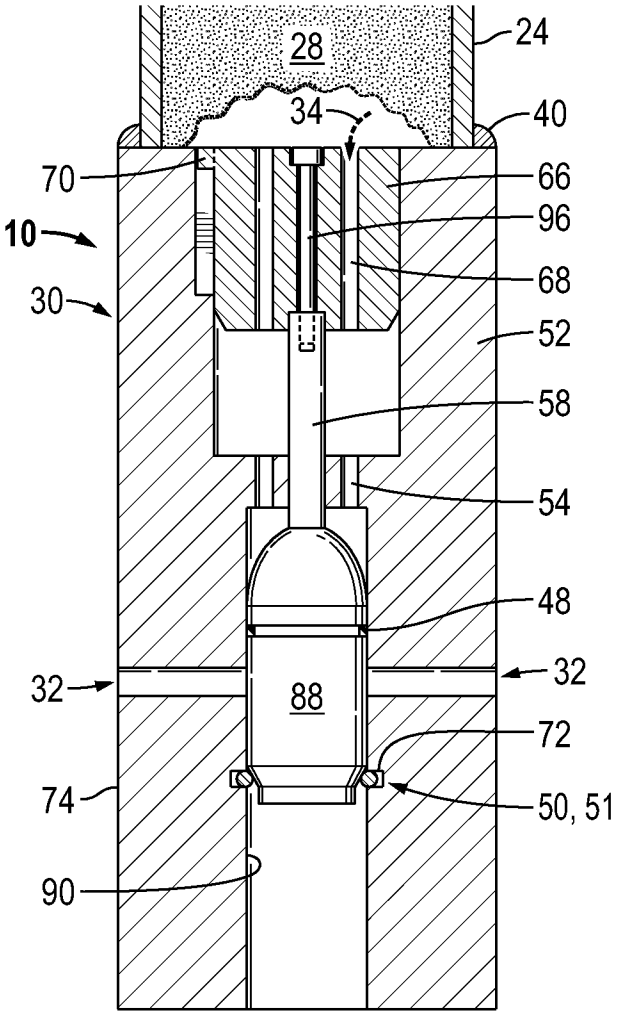
Figure 18:
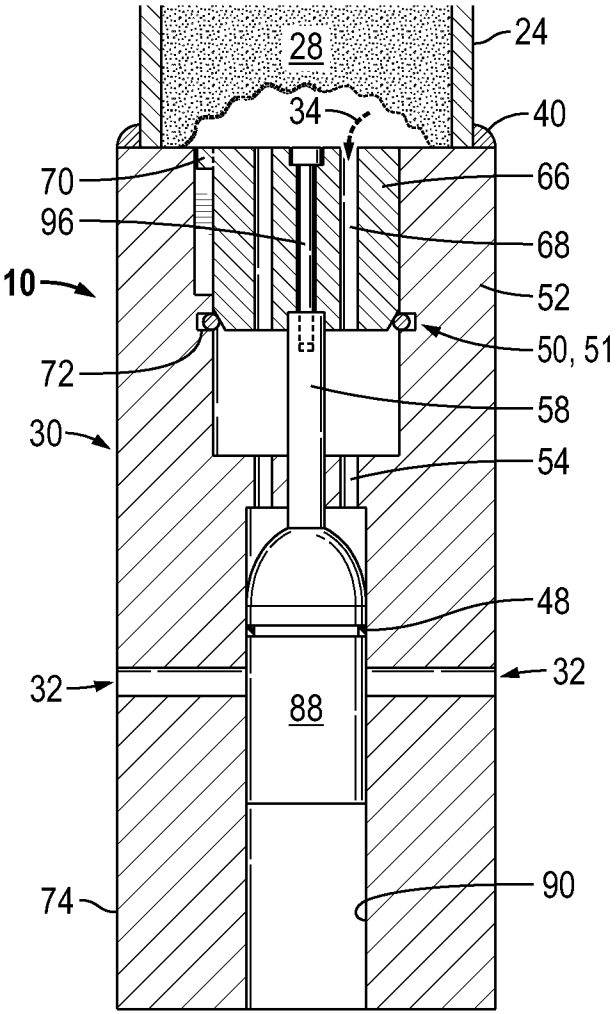

Refer now to FIGS. 18 and 19 which illustrate embodiments of a downhole tool 10 and penetrator head 30 that utilize holding element 50 in the form of a ring 51 (e.g., C-ring) to hold the shifting piston in the closed position under a preload force. In each of the embodiments the shifting piston 88 is connected to a piston head 66 disposed upstream of the diverter section 52 and channels 54 thereby maintaining the shifting piston in the cylinder 90 after it has been released from the holding element and moved to the open position. In FIG. 18, the ring type holding element 50, 51 is connected between the piston head 66 and the body 74 above the diverter section 52 and channels 54. In FIG. 19 the ring type holding element 51 is connected between the shifting piston 88 and the cylinder wall (i.e., body 74). When the downward force on the shifting piston 88 overcomes the force from the environmental pressure and the preload force, the ring type holding member is expanded into the recess 72 and releasing shifting piston 88 to move to the open position.

Figure 20:
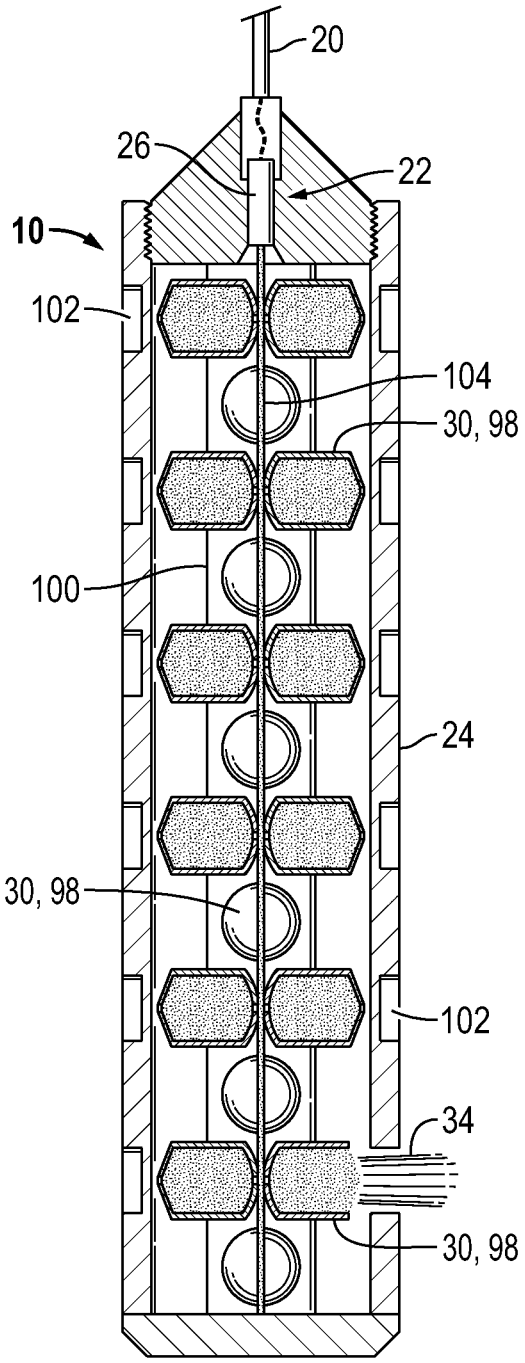
FIG. 20 illustrate an example of a non-explosive downhole tool utilizing a plurality of non-explosive thermate charges in accordance to one or more aspects of the disclosure.

Refer now to FIGS. 20 to 23 illustrating various aspects of a non-explosive downhole tool 10. FIG. 20 illustrates an example of a downhole tool 10 arranged as a perforating or puncher type of tool. The depicted downhole tool 10 comprises a plurality of thermate penetrator heads, generally identified with the numeral 30 and identified specifically with the number 98. The thermate penetrator heads 30, 98 are located on a loading tube 100 in a desired axial and or circumferential pattern. In the embodiment of FIG. 20 the loading tube is disposed in a carrier body 24. Examples of thermate penetrator heads 30, 98 are described with reference to FIGS. 21 and 23 below. The tool 10 is conveyed on a conveyance 20, e.g. wireline or tubing, into a wellbore for example as illustrated in FIGS. 1 and 2. The non-explosive downhole tool 10 includes a firing head 22 and an igniter 26. The igniter 26 may be initiated for example in response to an electrical signal which may be transmitted via conveyance 20. Each of the thermate penetrator heads 30, 98 may be positioned adjacent to a respective scallop 102 formed in the carrier body 24. A single fuse cord 104, comprising thermite or thermate, interconnects all of the thermate penetrator heads 30, 98 to a single igniter 26. As will be understood by those skilled in the art with benefit of this disclosure, tool 10 may be constructed and utilized without a carrier body 24 (e.g., gun carrier). Upon ignition of the thermate penetrator heads 30, 98 a product 34 jet is discharged radially from the tool 10. The product 34 jet may include gas and a molten metal for example from the thermate chemical reaction and from the melting of the carrier body 24 at scallops 102.

Figure 21:
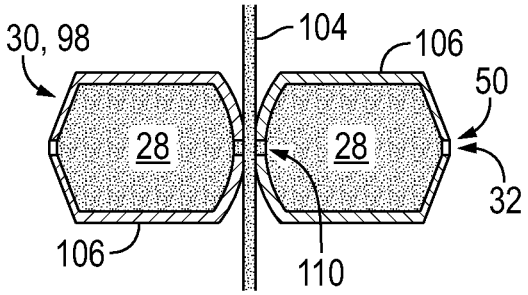
FIG. 21 illustrates non-explosive thermate charges operationally connected with a fuse cord according to one or more aspects of the disclosure.
Figure 23:
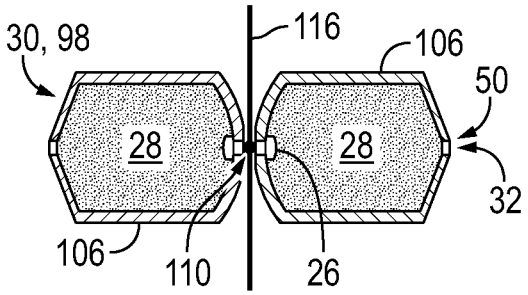
FIG. 23 illustrates non-explosive thermate charges including igniters according to one or more aspects of the disclosure.

With reference to FIGS. 21 and 23 the thermate penetrator heads 30, 98 comprise a casing or housing 106 filled with a thermate material as the energy source 28. The housing 106 comprises a discharge or ejection port 32 and an ignition point 110 opposite the ejection port 32. The ejection port 32 may be closed by a holding mechanism, for example a weakened portion of the housing, prior to igniting the thermate charge. Similarly, the ignition point may be a weakened portion of the housing or an opening.

In FIG. 21 the thermate penetrator heads 30, 98 are ignited by a thermate or thermite fuse cord 104 that is disposed adjacent to the ignition point 110 which in this example is a thin-wall section of the housing. The high temperature of the ignited fuse cord 104 will ignite the thermate energy source 28 which will produce molten metal that is ejected with a gas jet through the ejection port 32.

Figure 22:
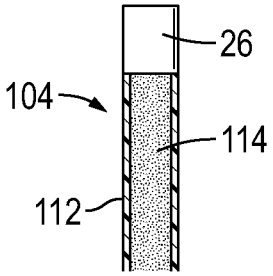
FIG. 22 illustrates a non-explosive fuse cord according to one or more aspects of the disclosure.

An example of a fuse cord 104 is described with reference to FIG. 22. Fuse cord 104 includes a sleeve 112 filled with thermite or thermate, which is generally identified with the numeral 114. The material 114 may be the same material that is used for the energy source 28.

FIG. 23 illustrates the thermate or thermite fuse cord replaced with an ignition line 116, i.e., an electric line. In this example, each of the thermate penetrator heads 30, 98 includes an igniter 26 that is located at the ignition point 110.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A non-explosive downhole cutting or perforating tool for creating openings in tubulars and/or earthen formations, the tool comprising:

a carrier holding a thermate material;

an igniter in operational contact with the thermate material;

a head connected with the carrier and having a port to eject a product produced from the thermate material upon ignition of the thermate material, the product to create openings in tubulars and/or earthen formations, and the head having a communication path extending from the thermate material to the port; and a moveable member in a closed position blocking the communication path and in an open position opening the communication path, wherein the moveable member is operated from the closed position to the open position in response to ignition of the thermate material, wherein the moveable member is a valve member of a one-way valve.

2. The tool of claim 1, comprising a holding element applying a preload force to the moveable member.

3. The tool of claim 1, comprising a holding element applying a preload force to the moveable member, wherein the holding element comprises one of a shear member, a c-ring, a biasing element and a dissipating element.

4. The tool of claim 1, wherein the head has a larger outside diameter than the carrier.

5. The tool of claim 1, wherein the port forms substantially a 360 degree opening.

6. The tool of claim 1, where the head comprises two or more ports arranged circumferentially and or axially relative to one another.

7. The tool of claim 1, wherein the port is a substantially 360 degree opening formed between the moveable member in the open position and a first body of the head.

8. The tool of claim 7, comprising a holding element applying a preload force to the moveable member, wherein the holding element is one of a dissipating member and a C-ring.

9. The tool of claim 7, comprising a shear member connected between the first body and the head when in the closed position.

10. The tool of claim 1, wherein the moveable member is a piston disposed in an axial cylinder in the communication path.

11. The tool of claim 10, comprising a dissipating element applying a preload force to hold the piston in the closed position, wherein the dissipating element degrades in response to exposure to the product.

12. The tool of claim 10, comprising a holding element applying a preload force to maintain the piston in the closed position, the holding element comprising one of a shear member and a c-ring.

13. A method of creating an opening in a tubular, comprising:

disposing a non-explosive cutting or perforating tool in a tubular in a wellbore, the tool comprising a thermate material, a moveable valve member of a one-way valve, and an ejection port;

igniting the thermate material;

displacing the moveable member in response to a product produced from the ignited thermate material;

opening the port in response to the displacing the moveable member, opening the port comprising displacing a moveable member disposed in a communication path between the port and the thermate material; and directing the product through the port and onto the tubular thereby creating an opening in the tubular.

14. The method of claim 13, wherein the port is a substantially 360 degree opening.

15. The method of claim 13, wherein the opening the port comprises axially moving a moveable member relative to a first body, wherein the open port is a substantially 360 degree opening.

16. A non-explosive downhole tubular cutter, the cutter comprising:

a carrier body holding a thermate material;

a head connected to the carrier body and comprising a diverter section and a one-way valve comprising a body axially moveable relative to the diverter section from a closed position in contact with the diverter section to an open position forming a 360 degree port between the axially separated body and diverter section in response to a product produced from ignited thermate material upon ignition of the thermate material; and a channel extending through the diverter section from the thermate material to the port.

17. The cutter of claim 16, comprising a holding element connected between the diverter section and the body to apply a preload force to urge the body to the closed position.

18. The cutter of claim 16, wherein the head has a larger outside diameter than the carrier.

* * * * *